United States Patent [19]

Pudwill

[11] Patent Number: 4,541,142

[45] Date of Patent: Sep. 17, 1985

[54] VACUUM CLEANER

[75] Inventor: Horst Pudwill, Hong Kong, Hong Kong

[73] Assignee: CEP Continental Engineering Products Co., Ltd., Kowloon, Hong Kong

[21] Appl. No.: 516,355

[22] Filed: Jul. 22, 1983

[30] Foreign Application Priority Data

Jan. 12, 1983 [DE] Fed. Rep. of Germany ... 8300676[U]

[51] Int. Cl.[4] ..... A47L 9/00

[52] U.S. Cl. ..... 15/323; 15/327 C; 15/344

[58] Field of Search ..... 15/327 C, 323, 327 D

[56] References Cited

U.S. PATENT DOCUMENTS

| | | | |
|---|---|---|---|
| 2,532,264 | 11/1950 | Smith | 15/323 X |
| 2,731,103 | 1/1956 | Ortega | 15/323 X |
| 2,794,513 | 6/1957 | Hultberg et al. | 15/323 X |
| 3,267,510 | 8/1966 | Cote | 15/344 |
| 3,328,826 | 7/1967 | Amos | 15/323 |
| 3,599,273 | 8/1971 | Shirayanagi | 15/327 C X |

*Primary Examiner*—Chris K. Moore

*Attorney, Agent, or Firm*—Holman & Stern

[57] ABSTRACT

A portable vacuum cleaner has a two-part housing comprised of an upper part and a lower part, a handle attached to the upper part by two enlarged substantially arcuate shaped end portions on the handle, a recess formed between the arcuate portions and a part of the housing for the removable storage of accessories such as nonflexible extension tubes, a motor within the housing, a rechargeable battery within the housing to drive the motor, a turbo-impeller within the housing operatively connected to the motor to be driven thereby, a dust collecting means in the housing, a dust filter surrounding the impeller and protecting the impeller and motor from dust collected in the dust collecting area, and an opening in the housing for the attachment of accessories operably connected to the suction circuit produced by the impeller.

5 Claims, 4 Drawing Figures

VACUUM CLEANER

BACKGROUND OF THE INVENTION

1. Field of the Invention

The present invention relates to a vacuum cleaner, preferably a portable vacuum cleaner, consisting of several housing parts one of which is detachable and provided with a handle.

2. Description of the Prior Art

Vacuum cleaners including portable vacuum cleaners are generally known. The disadvantage of such vacuum cleaners is that when provided with an electric power cord they are awkward to handle and, moreover, have an inferior suction capacity. It is altogether difficult to take such portable vacuum cleaners on a ladder, because the electric power cord is inconvenient and combersome.

A further disadvantage for the operating person may be that he has to hold the suction tube and different nozzles for example in one hand, while the other hand holds the device itself, which creates the possibility of a danger of an accident.

For these reasons, such portable vacuum cleaners are mainly used for cleaning upholstery, automobiles etc., i.e. for things located on the ground. The cleaning of curtains, wall-paper etc. is in most cases made by grounded vacuum cleaners, fitted with lengthening pieces for the suction tubes demanding a certain energy effort.

BRIEF SUMMARY OF THE INVENTION

It is the object of the present invention to provide a portable vacuum cleaner which is compact, transportable and easy to handle, is provided with a high suction capacity and does not contain any inconvenient and awkward parts.

According to the invention this aim is achieved by a compact shoulder strap device which has in addition to a handle an additional carrying strap and whose housing contains fastening means for accessories, these fastening means being arranged within the shape of the vacuum cleaner so that the accessories fastend thereto do not extend beyond the shape of the vacuum cleaner itself. For this reason the handle is provided on both ends with substantially arcuately shaped prolongations which form an undercut and whose form is similar to that of accessories which are to be placed therein.

A further feature of the invention is that a rechargeable battery is provided in the housing and the motor with its turbo-impeller penetrates into the lower part of the housing which is designed as a dust-catcher. The motor is protected from dust by a dust filter, and the turbo-impeller is arranged vertically to the axis of the opening of the suction tube in such a way that it is located a certain distance therefrom.

It is of further advantage that the shape of the housing is contoured in order to enable a comfortable use of the device. For the same reason the edges of the housing are smooth. Moreover, the operating person is able to transport the vacuum cleaner according to the invention without any difficulties, hanging it either over one of his shoulders or carrying it by its handle while using it. He can make use of all the necessary accessories for a particular operation without being hindered by an awkward electrical power cord and he can rely on a high suction capacity for a certain period of time.

BRIEF DESCRIPTION OF THE DRAWING

The invention will be more fully understood from the detailed description of the preferred embodment thereof with reference to the accompanying drawings wherein.

DETAILED DESCRIPTION

Figure 1:
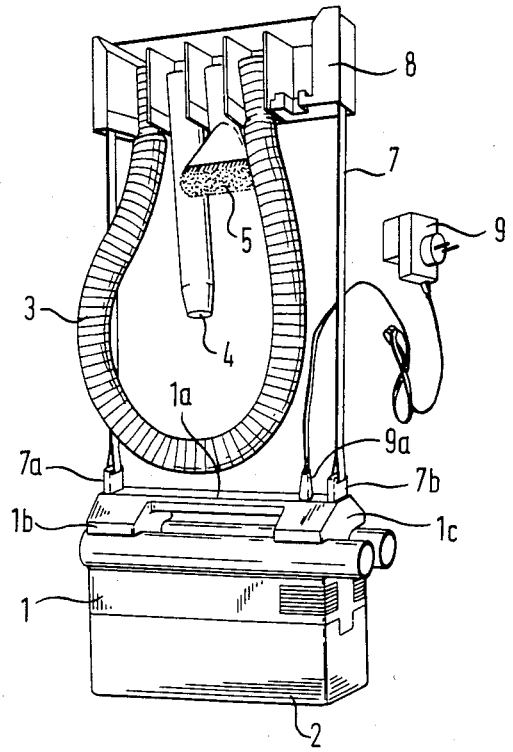
FIG. 1 is a schematic perspective view of the invention.
Figure 2:
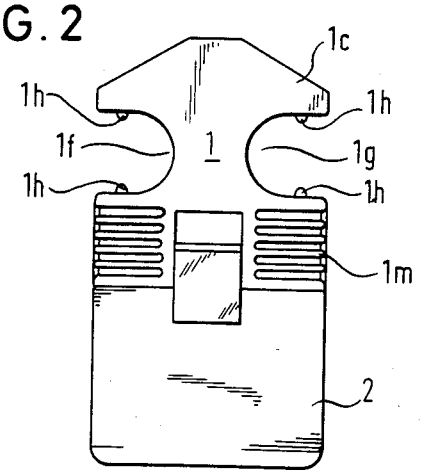
FIG. 2 is a front elevational view of the vacuum cleaner shown in FIG. 1.
Figure 3:
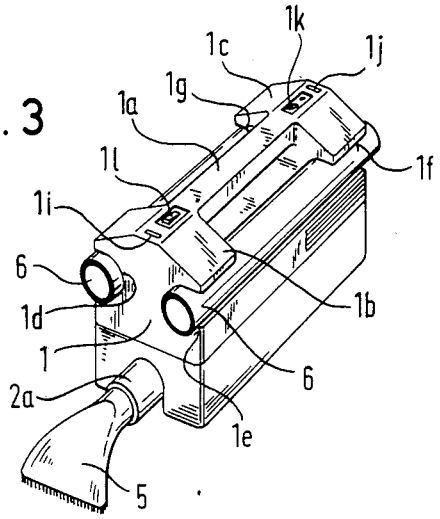
FIG. 3 a perspective view showing the portable unit.
Figure 4:
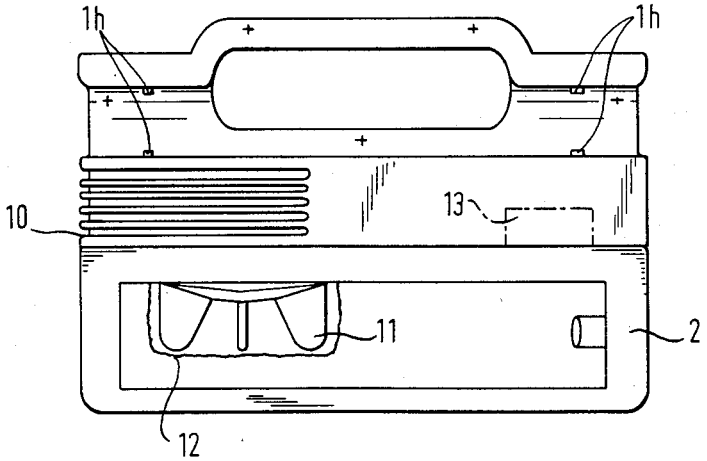
FIG. 4 is a side elevatational view of the vacuum cleaner shown in FIG. 1.

The portable vacuum cleaner described herein consists mainly of an upper housing part 1, a lower housing part 2, which is connected with the upper part in a suitable manner the plugged-in accessories are fastened to the lower housing part, as for example flexible suction tubes 3, different nozzles 4, suction brushes 5 and lengthening parts 6.

The upper part of the portable vacuum cleaner according to the present invention is fitted with a handle 1*a*, which is integrated into the housing part 1 and has at both ends substantially arcuately shaped prolongations 1*b*, 1*c* inbond to its longitudinal axis. These two bowlike prolongations 1*b* and 1*c* are provided with one undercut on each, 1*d*, 1*e*, 1*f*, 1*g*, on both sides of the handle and shaped for receiving different accessories, as for example extension pieces 6, or nozzles 4, etc. For this reason the undercuts are at least adapted to the shape of the accessories and are designed for clamping. Also projections 1*h* for locking the accessories within the undercuts 1*d*, 1*f*, 1*e*, 1*g* respectively may be provided. Instead of an undercut a pockethole or several different shaped holders for the accessories may be provided on the housing.

At each end location on the upper housing part 1, one slot 1*i* and 1*g* 1*j* is provided, especially within the area of the arcuate prolongation 1*b* and 1*c* to lock the clips of the carrying strap 7. This carrying strap 7 can be used either to carry the vacuum cleaner over the shoulder for transport or to hang the vacuum cleaner over a holder 8 for storage. Further accessories can be fastened to a carrying strap 7. The upper housing part 1 is provided with a socket 1*k* for receiving a plug connector 9*a* of the battery charger 9 as well as with a receptacle 1*l* for the electric power switch, signal lamp etc.

Within the upper housing part 1 are located the electrical motor 10, connected to turbo-impeller 11 with its dustfilter 12, and a battery 13. Exhaust slots 1*m* are located in the upper housing part 1.

The lower housing part 2 contains the turbo-impeller 11 together with its dust filter 12 and has an opening 2*a* for acceptance of receiving suction tube 3, the nozzles 4 or other accessories. The lower housing part 2 can also serve as a dust catcher, so that a special dust-bag is superfluous because the turbo-impeller 11 and the motor 10 are protected by means of dust filter 12, penetrating into the dust catcher.

The vacuum cleaner is fitted with a powerful battery 13 to operate for a long time independent from the electric wall socket.

The turbo-impeller 11 is preferably located at a distance from the opening 2*a* and arranged perpendicular to the axis of the opening 2*a*, so that the rear part of the dust filter 12 is less exposed to the aspirated dust and the turbo-impeller works more effectively.

The vacuum cleaner according to the present invention is convenient to use also on ladders etc., independent of any power supply, without electrical power cords and consequently without hampering the operator. Necessary accessories, needed for the operation, are readily available and applicable without putting the vacuum cleaner on the ground. The operator does not have to leave his working place due to the fact that the vacuum cleaner is carried over the shoulder by means of the carrying strap 7. The compact housing with all the accessories contained within its shape does not hamper or interfere with the operator. The danger of accident is effectively prevented by means of the smoothened form of the housing. The housing of the vacuum cleaner can advantageously be contoured by means of concave shaping of its inner side which is nearest to the operator.

It is also apparent that the present invention is not restricted to the embodiment as described and defined above. Many modifications and variations may be made without departing from the spirit of the present invention. For example, the battery charging set 9 may be integrated within the housing itself or the locking of the carrying strap may be carried out in a different manner. Moreover, a clamping ring within the undercuts 1*d*, 1*e* 1*a*, 1*f*, 1*g*, may be provided for the fixation of the accessories 4, 5 and 6. Also other, softer materials for suitable fastening means may be provided.

I claim:

1. A portable vacuum cleaner comprising:

a housing having an upper part and a lower part;

means for detachably connecting said upper and lower parts together;

a handle on said upper part having an elongated hand grip portion;

a substantially arcuately shaped enlarged portion at each end of said handle connecting said handle in spaced relationship to said upper part so that an opening is provided between said handle and said upper part to accommodate at least part of the user's hand;

a recess on at least one side of said handle extending within said housing formed between said arcuately shaped portions and said upper part having a shape similar to accessories to be used with the vacuum cleaner and adapted to receive said accessories so that said accessories are removably insertable into said recess to be substantially completely contained therein within the external surface of the housing;

means in said recess on said upper part to removably fasten said accessories within said recess so that said accessories do not extend substantially beyond the outer surface of said housing;

an elongated shoulder strap device attached at its ends to said housing to support said housing thereby;

suction producing means within said housing;

dust collecting means within said housing operatively connected to said suction producing means; and an opening on said housing to operatively and removably connect accessories to said suction producing means.

2. A vacuum cleaner as claimed in claim 1 wherein said suction producing means comprises:

an electric motor mounted within said upper part of the housing;

a rechargeable battery mounted within the housing and operatively connected to said motor to drive said motor; and a turbo-impeller operatively connected to said motor to be driven thereby and disposed within said lower part of the housing, and rotatable about an axis extending substantially perpendicular to the axis of said accessory connecting opening and spaced therefrom.

3. A vacuum cleaner as claimed in claim 2 wherein said dust collecting means comprises:

said lower part of the housing; and a dust filter operatively mounted between said lower part of the housing and said impeller and motor so that said impeller and motor are screened from dust drawn into said lower part by said impeller.

4. A vacuum cleaner as claimed in claim 3 wherein said housing is contoured so that the edges thereof are rounded and smooth.

5. A vacuum cleaner as claimed in claim 4 wherein a said recess is provided on both sides of said handle and are provided with said removable fastening means for accessories.

* * * * *